United States Patent [19]

Reneau

[11] 4,143,584

[45] Mar. 13, 1979

[54] ELECTROHYDRAULIC SERVO ACTUATOR WITH CENTERING CONTROL

[75] Inventor: Dale M. Reneau, Santa Barbara, Calif.

[73] Assignee: General Motors Corporation, Detroit, Mich.

[21] Appl. No.: 824,466

[22] Filed: Aug. 31, 1977

[51] Int. Cl.[2] ..... F01B 1/00; F01B 7/00

[52] U.S. Cl. ..... 91/172; 91/360; 92/62

[58] Field of Search ..... 91/447, 360, 170, 172; 92/131, 13.1, 62, 65

[56] References Cited

U.S. PATENT DOCUMENTS

| | | | |
|---|---|---|---|
| 2,478,790 | 8/1949 | Stephens | 92/13.1 X |
| 2,918,902 | 12/1959 | Robinson et al. | 91/447 X |
| 3,149,537 | 9/1964 | Fink | 92/62 X |

FOREIGN PATENT DOCUMENTS

| | | | |
|---|---|---|---|
| 529866 | 11/1940 | United Kingdom | 91/170 R |
| 911709 | 11/1962 | United Kingdom | 92/62 |

*Primary Examiner*—Irwin C. Cohen
*Attorney, Agent, or Firm*—Donald F. Scherer

[57] ABSTRACT

An electrohydraulic actuator has a power piston which is controlled from movement between the ends of its travel for performing work by servo control valve. When the actuator is not performing work, the power piston is abutted on one side by a pressure positioned centering piston which prevents the movement in one direction. High pressure fluid operates on the other side of the power piston to prevent movement in the other direction so that the power piston is centered in the cylinder and cannot be moved by external forces.

1 Claim, 2 Drawing Figures

ELECTROHYDRAULIC SERVO ACTUATOR WITH CENTERING CONTROL

The invention described herein was made in the course of work under a contract or subcontract thereunder with the Department of Defense.

This invention relates to hydraulic actuators and more particularly to hydraulic actuators having self-centering mechanisms.

It is an object of this invention to provide an improved electrohydraulic actuator having a self-centering control and mechanism.

Another object of this invention is to provide an improved electrohydraulic actuator wherein the power piston is positioned in the center of its stroke by a centering piston and fluid pressure.

A further object of this invention is to provide an improved hydraulic actuator wherein the power piston has disposed circumjacent thereto a centering piston with a cylindrical extension, which centering piston is moved by fluid pressure and the power piston is pressurized on one side to abut the extension thereby establishing the centered position for the power piston.

Other objects and advantages of this invention will be more apparent from the following description and drawings in which.

Figure 1:
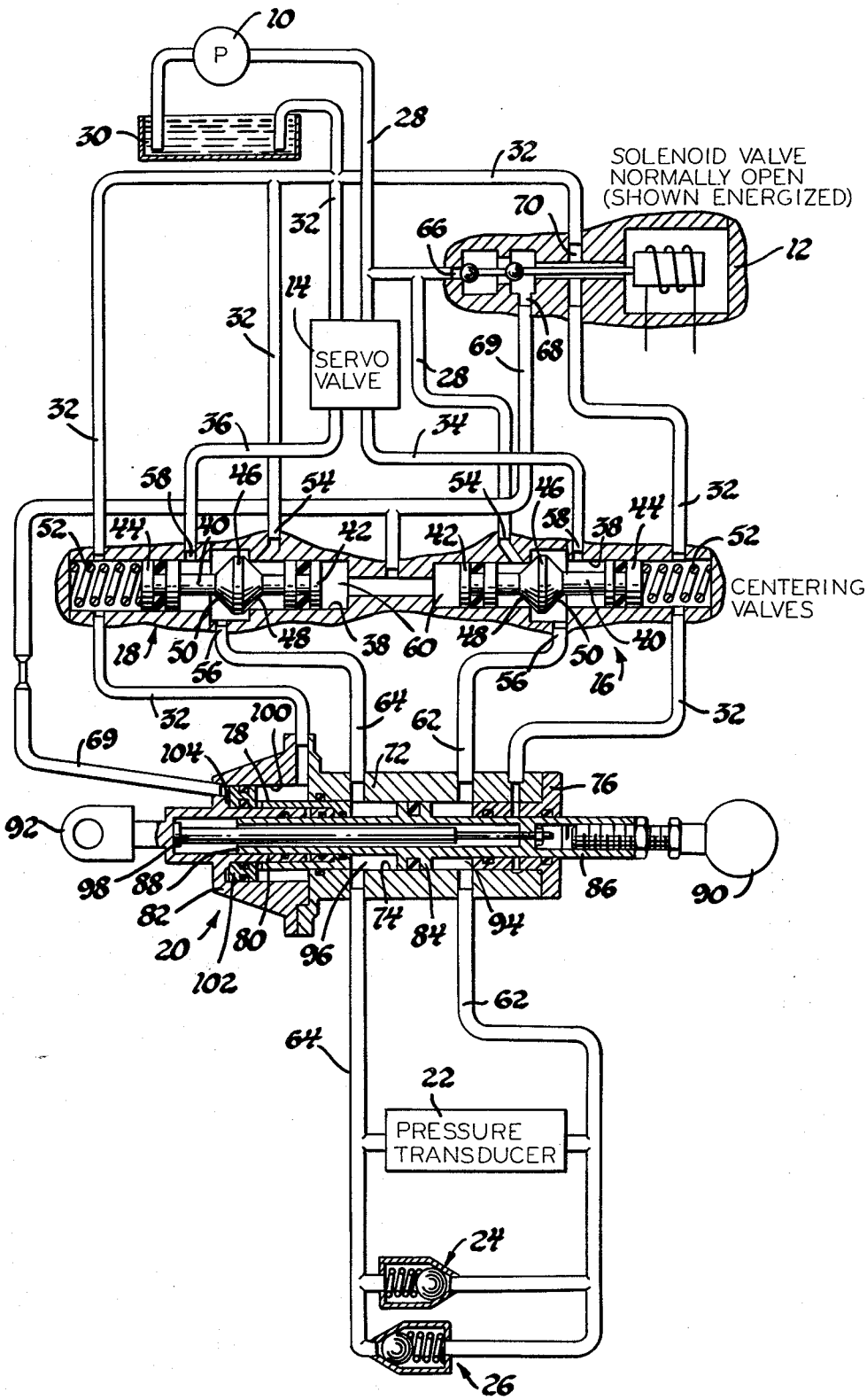
FIG. 1 is a diagrammatic view of an electrohydraulic actuator.

Referring to the drawings, particularly FIG. 1, there is shown a hydraulic system having a pump or fluid source 10 which delivers fluid pressure to the system, which includes a solenoid valve 12, a servo valve 14, two centering valves 16 and 18, a hydraulic actuator 20, a pressure transducer 22 and a pair of cross port relief valves 24 and 26. The pump 10 is in fluid communication via passage 28 with the servo valve 14 and the solenoid valve 12. The servo valve 14 is also in fluid communication with a reservoir 30 via exhaust or return passage 32. The output of the servo valve has two passages 34 and 36 which are in fluid communication with the centering valves 16 and 18 respectively. The servo valve 14 is a conventional type mechanism such as model 32 S-020 by MOOG Inc.

The centering valves 16 and 18 are substantially identical in construction such that a description of one of the valves will suffice. Each centering valve has a bore 38 in which is disposed a spool valve 40, having lands 42 and 44 formed at the ends thereof, and a centrally located valve section 46 which has conical surfaces 48 and 50 formed thereon. The valve spool 40 is positioned in the bore 38 by a spring 52 which urges valve 16 to the left and valve 18 to the right as seen in FIG. 1. In the spring set position, the conical portion 48 is seated against a portion of valve bore 38 so as to prevent fluid communication between a port 54 and a port 56. However, in this spring set position the port 56 is in fluid communication with a port 58. The valve land 42 cooperates with valve bore 38 to form a pressure chamber 60 which cooperates with the valve spool 40 such that when fluid pressure is admitted to chamber 60 the valve spool 40 of centering valve 16 is moved to the right against spring 52, and centering valve 18 is moved to the left against its spring 52. In the pressure set position, the conical portion 50 cooperates with a portion of valve bore 38 to prevent fluid communication between ports 58 and 56 while permitting fluid communication between ports 54 and 56. The ports 54 of centering valve 16 and 18 are in fluid communication with passages 28 and 32 respectively. The ports 58 of centering valves 16 and 18 are in fluid communication with passages 34 and 36 respectively, and the ports 56 of centering valves 16 and 18 are in fluid communication with passages 62 and 64 respectively which passages are also in fluid communication with the hydraulic actuator 20.

The solenoid valve 12 is a conventional type valve and has an inlet port 66 which is in fluid communication with passage 28 and an outlet port 68 which is in fluid communication, through passage 69, with the pressure chambers 60, of centering valves 16 and 18, and the hydraulic actuator 20. The solenoid valve 12 also has an exhaust port 70 in fluid communication with the exhaust or return passage 32. In the energized position shown, a solenoid valve 12 closes the port 66 and opens the port 68 to the port 70 thereby permitting fluid in the pressure chamber 60 to be connected to exhaust to passage 69. When the solenoid valve 12 is deenergized, the port 66 is open to the port 68 while the port 68 is closed to the port 70 so that fluid pressure from the pressure source 10 is directed via passage 69 to the pressure chamber 60 thereby moving the centering valves to the pressure set position.

The hydraulic actuator 20 includes a housing 72 in which is formed a bore 74. The bore 74 is closed at one end by an end cap 76 and at the other end by a centering piston 78 which is telescoped about a cylindrical portion 80 of an end cap 82. Slidably disposed in the bore 74 is a power piston 84 which has an output rod end 86 slidably disposed in the end cap 76 and another rod end 88 slidably disposed in the end cap 82 and a portion of the centering piston 78. The rod end 86 has secured thereto a spherical member 90 which permits connection between the power piston 84 and the member to be actuated thereby. The end cap 82 has formed thereon a clevis 92 which permits the end cap 82 and housing 72 to be grounded such that the power piston 84 will be movable relative to the housing 72. The power piston 84 divides the bore 74 into two working chambers 94 and 96 which are in fluid communication with passages 62 and 64 respectively. Axially located in the power piston and end cap 82 is a conventional linear variable displacement transformer (LVDT) 98 which has one portion grounded to the housing 82 and the other end secured to the power piston 84 such that the LVDT 98 is subjected to the movement between the power piston 84 and the housing 72 and thus provides a feedback signal for the servo valve 14 such that the positioning of the power piston 84 during working is accomplished in a normal and well known manner.

The end cap 82 has formed therein a bore 100 in which is slidably disposed a piston end 102 of a centering piston 78. The piston end 102 is in an annular recess in the cap 82, formed by bore 100 and cylindrical portion 80, and cooperates with the recess to form a pressure chamber 104 which is in fluid communication with the passage 69. Thus when the passage 69 is pressurized the centering piston 78 will be moved to the right as viewed in FIGS. 1 and 2 such that piston 102 will abut the housing 72 and the right end 106 of centering piston 78 will be positioned in bore 74 so as to abut the left face 108 of power piston 84 and thus maintain the left most centered position of the power piston. When the chamber 104 is pressurized, the chamber 94 will also be pressurized such that the right face 110 of power piston 84 will be subject to system pressure thus establishing the centering force for the right side of the power piston 84. Since the area of piston 102 is greater than the area of face 110 and the pressures therein are equal, the power piston 84 will be maintained in the central location against external forces that may be applied to the spherical connector 90. When the centering piston 78 is moved to the right to center the power piston 84, there is sufficient clearance between the bore 74 and the cylindrical extension portion 112 of the centering piston 78 to permit the fluid in chamber 96 to be exhausted through passage 64 which is in fluid communication with exhaust passage 32 when the power piston 84 is centered.

Figure 2:
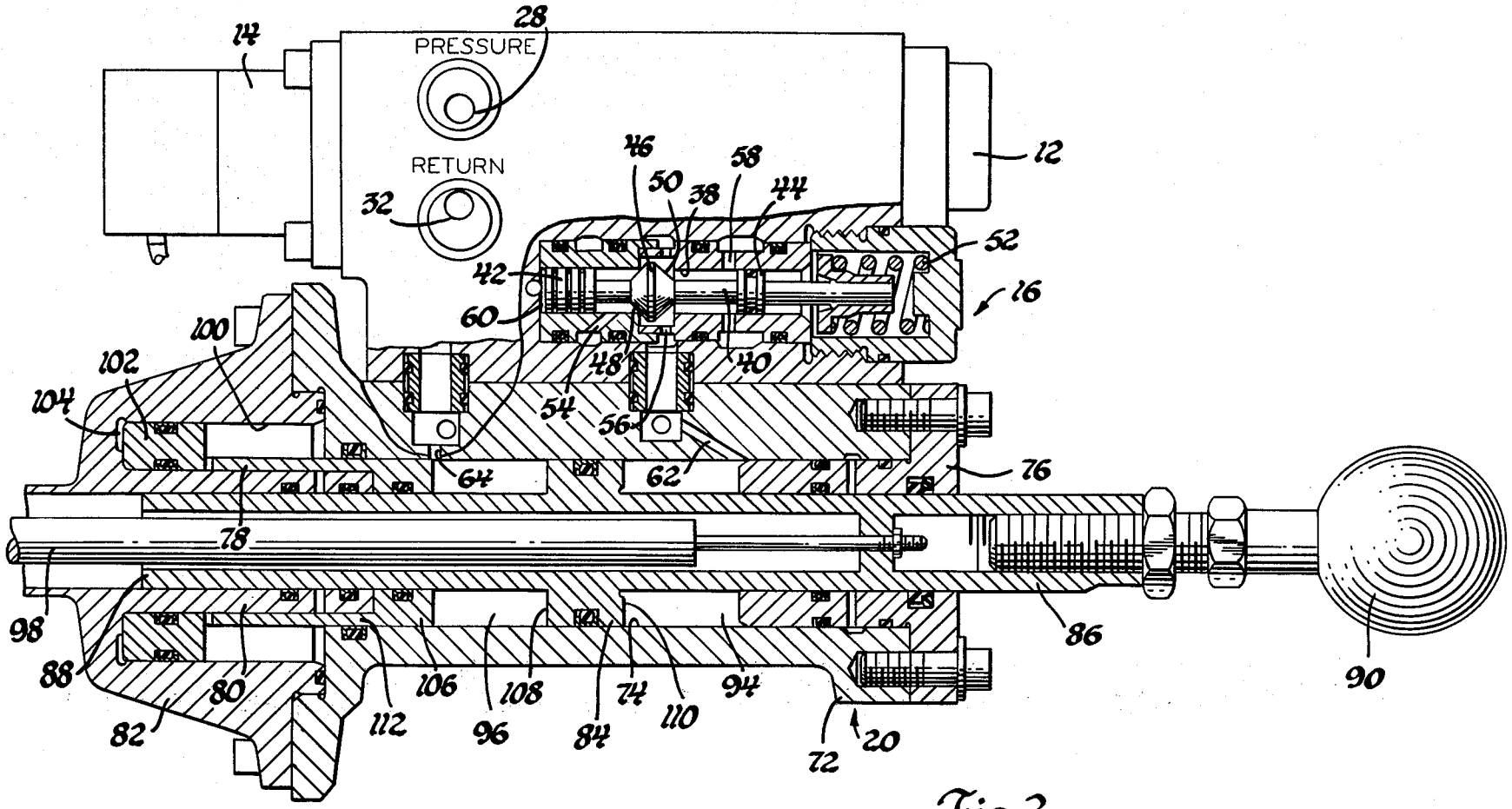
FIG. 2 is a side elevational view, partly in section, of a hydraulic actuator.

The pressure transducer 22 is a conventional differential pressure transducer which is in fluid communication with passages 62 and 64 and thereby is available to measure the differential pressure on the power piston such that the output force is readily obtainable and can be displayed through a conventional electric or electronic type display if desired. The cross port relief valves 24 and 26 have conventional ball check type relief valves which are interconnected between passages 62 and 64 to control the fluid pressure which may be generated within these passages and therefore limit the fluid pressure which can be developed on the power piston 84. The cross port relief valves 24 and 26 therefore provide a force limit function for the power piston 84. For example, if the passage 64, and therefore chamber 96, is pressurized to perform output work, the relief valve 26 will limit the maximum pressure build up and the maximum force output. The same function is true of relief valve 24, when the chamber 94 is pressurized to control the maximum fluid pressure which will act on power piston 84. The electrohydraulic actuator in FIG. 2 is the preferred embodiment thereof and is shown in an environment wherein the servo valve 14, solenoid valve 12 centering valves 16 and 18 and actuator 20 are assembled in a modular type package which may readily be incorporated into a system wherein the linear output of the actuator is desired to operate. The cross port relief valves and pressure transducer, not shown, are also included in the modular package.

During normal operation of the actuator, the solenoid valve 12 is in the energized position, as shown. The servo valve 14 is actuated by the operator to cause movement of the power piston 84. Assuming it is desirable to move the output of the power piston 84 to the right, the servo valve 14 is actuated such that pressure in passage 36 is increased and pressure in passage 34 is decreased. Fluid pressure in passage 36 passes through centering valve 18 to chamber 96, while chamber 94 is connected through passage 62, and centering valve 16 to passage 34. Thus the pressure unbalance on the power piston 84 causes the power piston to move to the right the amount desired by the servo valve. When this desired movement is completed the signal from the LVDT 98 is transmitted in a conventional manner back to the servo valve 14 to position the servo valve to balance the pressure in passages 34 and 36 which causes the same pressure values to be found in chambers 94 and 96 thereby maintaining the power piston 84 in the position desired by the operator.

If it is desired to move the output of the actuator 20 to the left, the servo valve 14 is operated in a manner to increase the pressure in passage 34 while the pressure in passage 36 is decreased. Pressurization of the passage 34 is communicated through centering valve 16 to chamber 94, while the chamber 96 is connected through passage 64 and centering valve 18 to passage 36. When the power piston 84 reaches the position desired by the operator, the LVDT 98 provides an electronic signal to the servo valve 14 to equalize the pressure in passages 34 and 36 and thereby maintain the power piston 84 in the position desired by the operator. The power piston 84 can be centered, if desired, by permitting the solenoid valve 12 to be deenergized whenever the servo valve 14 is in the null or centered position. When the solenoid valve 12 is deenergized, the passage port 66 is opened and the port 70 is closed. Thus fluid pressure passes through the solenoid valve 12 to passage 69 where it is communicated to pressure chambers 60 of the centering valves 16 and 18 and to chamber 104 of the centering piston 78. The centering valves 16 and 18 are moved against their respective springs 52 to their pressure set positions whereby the right face 110 of power piston 84 is pressurized through centering valve 16 and passage 62 and the left face 108 of piston 84 is exhausted. The centering piston 78 is extended due to the fluid pressure in chamber 104 such that the end 106 of centering piston 78 abuts the left face 108 of piston 84 whereby the piston 84 is maintained in its center location.

This same centering function is obtained whenever the solenoid valve 12 is disconnected from its power source such as during an electrical failure in the system or whenever the operator desires to deenergize the solenoid valve 12. Thus it can be seen that the electrohydraulic actuator as above described can be useful in aiming type devices where it is desirable to have the device to be aimed positioned centrally whenever off center aiming is not desired such that the operator will know the precise location of the output whenever the system is in a null condition or whenever a stoppage of electrical output occurs.

Obviously, many modifications and variations of the present invention are possible in light of the above teaching. It is therefore to be understood, that within the scope of the appended claims the invention may be practiced otherwise than as specifically described.

What is claimed is:

1. A hydraulic actuator for use with a source of fluid pressure, said actuator comprising; power output means having first and second fluid pressure chambers and power piston means separating said pressure chambers and being movable in one direction in response to fluid pressure in the first chamber and movable in another direction in response to fluid pressure in the other chamber; a source of fluid pressure; servo valve means between the pressure source and said power output means for selectively directing fluid pressure from the pressure source to said fluid pressure chambers; two centering valve means including spring means and pressure responsive means and a respective one of said centering valve means being disposed in fluid communication between said servo valve means and a pressure chamber of said power output and being movable to a spring set position to direct fluid from said servo valve means to and from said fluid pressure chambers and to a pressure set position; centering piston means movable to two positions and being disposed circumjacent a portion of said power piston means and having a cylindrical extension engageable with said power piston means to limit movement of the power piston means in one direction to a position central of the total power piston means movement when the centering piston means is in one position and limiting movement of said power piston means to the full movement of power piston means in said one direction when said first pressure chamber is pressurized and the centering piston means is in the other position; and center control valve means selectively operable to exhaust said pressure responsive means and to direct fluid pressure from said source to said pressure responsive means of said centering valve means whereby said centering valve means are moved to the pressure set position to disconnect said servo valve means from said fluid pressure chambers, to connect said second pressure chamber to exhaust, to connect said first pressure chamber to said source, and to connect said centering piston means to said pressure source whereby said centering piston means is moved to said one position, and said power piston means is restrained from movement in said one direction by said centering piston and restrained from movement in the other direction by fluid pressure in said first chamber.

* * * * *